US010918898B1

(12) United States Patent
Palacios

(10) Patent No.: US 10,918,898 B1
(45) Date of Patent: Feb. 16, 2021

(54) HOOP FORM PERSONAL EXERCISE DEVICE

(71) Applicant: Nestor Palacios, New York, NY (US)

(72) Inventor: Nestor Palacios, New York, NY (US)

( * ) Notice: Subject to any disclaimer, the term of this patent is extended or adjusted under 35 U.S.C. 154(b) by 47 days.

(21) Appl. No.: 16/042,451

(22) Filed: Jul. 23, 2018

Related U.S. Application Data

(60) Provisional application No. 62/535,340, filed on Jul. 21, 2017.

(51) Int. Cl.

| | |
|---|---|
| ***A63B 19/00*** | (2006.01) |
| ***A63B 21/00*** | (2006.01) |
| ***A63B 21/06*** | (2006.01) |
| ***A63B 23/12*** | (2006.01) |
| ***A63B 21/02*** | (2006.01) |
| ***A63B 23/035*** | (2006.01) |

(52) U.S. Cl.
CPC ..... *A63B 19/00* (2013.01); *A63B 21/0004* (2013.01); *A63B 21/00065* (2013.01); *A63B 21/023* (2013.01); *A63B 21/0603* (2013.01); *A63B 21/4035* (2015.10); *A63B 21/4043* (2015.10); *A63B 23/03516* (2013.01); *A63B 23/12* (2013.01)

(58) Field of Classification Search
CPC ..... A63B 19/00–04; A63B 21/0608; A63B 23/12; A63B 23/03516; A63B 21/0004; A63B 21/00065; A63B 21/023; A63B 21/4043; A63B 21/4035; A63B 21/0603
USPC ..... 482/124
See application file for complete search history.

(56) References Cited

U.S. PATENT DOCUMENTS

| | | | | |
|---|---|---|---|---|
| 2,036,524 | A * | 4/1936 | Girard et al. | A63B 19/00 446/450 |
| D261,788 | S * | 11/1981 | Burns | D21/682 |
| 4,356,915 | A * | 11/1982 | Phillips | B65D 85/58 206/315.1 |
| 4,480,831 | A | 11/1984 | Muller-Deinhardt | |
| 4,632,391 | A * | 12/1986 | Orak | A63B 21/0608 446/170 |
| 4,674,987 | A * | 6/1987 | Sober | A63B 21/0608 446/170 |

(Continued)

FOREIGN PATENT DOCUMENTS

KR 2005065484 A * 6/2005

*Primary Examiner* — Nyca T Nguyen
(74) *Attorney, Agent, or Firm* — Robert W. J. Usher

(57) ABSTRACT

A personal exercise device comprising a hoop-form tube containing ball weights for circulation, a handlebar cross-bridge spanning the tube diametrically and formed by a pair of bars extending side-by-side in spaced-apart, parallel relation across the tube. Pairs of elongate hand-grips are mounted transversely on the cross-bars such that the hand-grips can be grasped to orbit the device overhead to inevitably train core muscles of the trunk/torso when training muscles of the body extremities such as the arms and shoulders. The hand-grips can be parallel for exercising core muscles on opposite sides of the boy evenly; divergent for a semi-supinated grip; or convergent for a semi-pronated grip. Alternative handlebars are a single, zig-zag bar with hand grips on successive straight portions; a circular/wheel with hand-grips at intervals, mounted concentrically within the hoop by resilient supports bridging the hoop and handlebar; two arcuate bars spanning the hoop with hand-grips at intervals.

2 Claims, 12 Drawing Sheets

(56) References Cited

U.S. PATENT DOCUMENTS 5,342,273 A * 8/1994 Plendl ..... A63B 19/00 482/122
5,674,162 A * 10/1997 Ellingson ..... A63B 21/0608 482/110
5,692,944 A * 12/1997 Pellicone ..... A63B 21/0608 273/109
5,713,823 A * 2/1998 Walendzak ..... A63B 22/18 482/139
6,450,928 B1 * 9/2002 Larkins, Jr. ..... A63B 21/0608 482/106
7,094,186 B2 * 8/2006 Diakonov ..... A63B 21/0728 482/104
7,338,339 B2 * 3/2008 Mendel ..... A63B 19/00 446/236
D671,996 S * 12/2012 Wierszewski ..... A63B 21/0608 D21/680
8,556,781 B1 * 10/2013 Fitzpatrick ..... A63B 21/0724 482/106
8,608,628 B2 * 12/2013 Mathews ..... A63B 21/0602 482/108
8,814,765 B2 * 8/2014 Bernstein ..... A63B 21/0004 482/110
8,951,170 B1 * 2/2015 Tayo ..... A63B 21/0724 482/107
9,254,408 B1 * 2/2016 Otto ..... A63B 21/055
9,259,607 B2 * 2/2016 Kokenis ..... A63B 21/0608
2002/0177507 A1 * 11/2002 Carbone ..... A63B 23/025 482/10
2005/0070202 A1 * 3/2005 Mendel ..... A63B 19/00 446/236
2005/0095950 A1 * 5/2005 Mendel ..... A63B 19/00 446/236
2008/0116654 A1 * 5/2008 Cooney ..... A63B 19/02 280/206
2008/0153383 A1 * 6/2008 Mendel ..... A63B 19/00 446/236
2008/0153676 A1 * 6/2008 Krietzman ..... A63B 19/00 482/93
2011/0224054 A1 * 9/2011 Bernstein ..... A63B 21/0004 482/110
2012/0214649 A1 * 8/2012 Torres ..... A63B 21/22 482/110
2012/0329616 A1 * 12/2012 Theuer ..... A63B 19/00 482/122
2013/0337977 A1 * 12/2013 Kokenis ..... A63B 21/0608 482/8
2014/0357458 A1 * 12/2014 Callanan ..... A63B 21/02 482/129
2017/0106226 A1 * 4/2017 Mann ..... A63B 21/0724
2017/0128767 A1 * 5/2017 Jolly ..... A63B 21/4043
2018/0140893 A1 * 5/2018 Artioli ..... A63B 21/4035
2019/0143167 A1 * 5/2019 Bezemer ..... A63B 23/03508 482/110

* cited by examiner

HOOP FORM PERSONAL EXERCISE DEVICE

RELATED APPLICATION

Priority is claimed from my provisional application No. 62/535,340, filed Jul. 21, 2017, the disclosure of which is incorporated herein by reference.

FIELD OF THE INVENTION

The invention relates to a hoop-form personal exercise device for exercising/strengthening the core muscles of a user's trunk/torso simultaneously with muscles of the extremities.

BACKGROUND OF THE INVENTION

In personal body training, it is common practice to focus on exercising particular isolated sets or chains of muscles, commonly of the arms and shoulders, while neglecting other muscle groups even when in the same chain and adjacent. The resulting disparity of strength and conditioning can be a common cause of self-inflicted injury.

For example, arm and shoulder muscles may be trained sufficiently to enable a person to lift a heavy bag into an overhead bin on an airplane but core muscles of the lower back or abdomen may remain so unconditioned or weak that they are strained when removing and lowering the bag, particularly as the person's arms are then more likely to be outstretched, spacing the bag weight further away from the body with a commensurate increase in leverage/moment imposed on core muscles of the torso/trunk. In that case, increasing strength of the muscles of the extremities may be counter-productive in inducing and enabling persons to place core muscles at greater risk.

It is therefore desirable to obviate such risk of injury by providing a personal exercise device which inevitably exercises the core muscles when exercising muscles of the extremities.

A hoop-form personal exercise device disclosed in U.S. Pat. No. 4,480,831, issued 1984, the disclosure of which is incorporate herein by reference, comprises a hoop-form tube of diameter sufficient to encircle a users body, at least one weight contained for circulation in the tube and a pair of elongate hand grips extending in a same direction along diametrically opposite portions of the tube circumference periphery so that a standing user employing the hand grips to swing the device in a generally horizontal orbit overhead develops significant centrifugal force in the circulating weight to impose alternate push-pull exercising stresses on respective muscles of the users arms, shoulders and upper back, thereby exercising the component agonist and antagonist muscles.

However, a disadvantage of orbiting the prior device by utilizing hand grips on the circumferential periphery pf the tube is that, although that exercises the user's muscles of the arms shoulders and upper back, insufficient stress is relayed/radiated to the muscles of the lower torso/trunk (the core muscles) of the body as a result of excessive separation/divergence/of the users arms produced by holding the circumferential periphery of the tube.

SUMMARY OF THE INVENTION

An object of the invention is to provide a hoop-form personal exercise device which inevitably exercises/trains and strengthens the core muscles of a lower part of the users torso/trunk during exercising muscles of extremities.

According to the invention, this is achieved by mounting the pair of elongate, hand grips in side-by-side, spaced apart relation, inwardly of the circumferential periphery of the hoop, thereby relaying exercising stresses to the core muscles of the users trunk/torso including the abdominal and lower back muscles.

Preferably, a cross-bridge spans the hoop and the hand grips are mounted on the cross-bridge to extend transversely thereof.

It is further preferred that the cross-bridge comprises a pair of parallel, hoop-spanning cross-bar members extending side-by-side in adjacent, spaced-apart relation in the plane of the hoop and the hand grips span respective cross-bar members.

Advantageously, the hand grips extend in parallel relation stressing core muscles on left and right sides of the body uniformly.

Additionally, a further pair of elongate, spaced apart, hand grips are mounted on the cross-bridge to extend transversely thereof, at locations spaced inwardly of respective hand grips of the parallel hand grips, the hand grips of the further pair being divergent for a semi-supinated grip.

Preferably, an additional pair of elongate, spaced apart, hand grips are mounted on the cross-bridge, spaced inwardly of respective hand grips of the pair of divergent hand grips, the hand grips of the additional pair being convergent for a pronated grip.

Adopting the semi-supinated grip particularly exercises the triceps as a prime mover when compared with the semi-pronated grip with the chest at a mechanical disadvantage but with greater activation of the back muscles. During frontal spinning/orbiting with a parallel grip there will be a disproportionate stress on the front deltoid whereas with a semi-pronated grip here will be greater activation of the medial deltoid.

It will be appreciated that user's body position for use of the exercise device is not limited to when standing still but includes when walking, running, sitting upright, kneeling, squatting and lying on the back.

It should also be appreciated that given a requirement for hoop stability during the production of high centrifugal forces needed to stress the core muscles in addition to muscles of the extremities, the user's hands must face in opposite directions, preferably with the fingers towards each other, to counter-balance the weakness of a (front), finger gripping action relative to a stronger back grip, which is only possible when the hand grips have a major component located in a common direction, preferably in side-by-side relation and not if there is only a single cross-bar with hand grips located in-line thereon to face in a same direction as then, for example, if both hands face to the front when gripping the hand-grips, the user would usually be unable as a result of relative weakness to prevent the front of the orbiting hoop from dipping.

The exercise apparatus facilitates user-generated centrifugal energy that represents, arguably, the most dynamic stress that can be applied on working skeletal muscles. The exercise induced stress that's applied onto the working muscle groups, as a result of counter-balancing radially revolving (centrifugal) forces presents a significant advancement in resistance conditioning. The apparatus is designed to optimize core function by stressing the prime movers (agonist muscles) while simultaneously recruiting reactively opposing muscles (antagonist muscles) in one fluid movement. Then as the ball weight continues to spin around the hoop, the agonist and antagonist muscles reverse roles in an instant during each individual revolution of the ball.

In other words, the unit comprises a hollow circular ring, through which the ball weight will travel, and a cross-bridge, which a user will hold and generate movement of the weighted ball. The centrifugal force created is contained within the unit and the sustained spinning [revolutions] of the ball recruits working muscles as an integrated unit.

Exercise that requires synergistic contribution of constituent muscle groups yields improvements in biomechanical function, a failure of traditional exercise. Exercise that fires on groups of muscles to contract in tandem proffers strength gains that are not just exercise-specific but transferable to real world physical activities. This a foundational principle in exercise science, establishing that exercise must recruit muscle groups to act as a cohesive unit to force the adaptation of improved function. This speaks to the concept of strength transferability. Conversely, most traditional exercises, particularly those that engage muscles in isolation and in straight linear movements yield strength improvements that are observed only within the execution of that exercise itself. Moreover, a long term fitness program that emphasizes isolation work—the deliberate activation and stress of individual muscle groups alone—has been shown to retard biomechanical function and predispose injury.

An additional benefit to working muscles under the stress of manipulating a centrifugal resistance, from above or away from the body, is in improvements in neuromuscular proprioception—the body's ability to know where it is, at any given moment, in space. That is, by definition, what we know as balance. Due to the radially revolving nature of a rapidly spinning resistance, muscle contractions oscillate between concentric and eccentric functions in continuous succession. The effort becomes a demand on neural pathways to the working muscles innervated, an adaptation that yields changes in improved balance.

The term core refers to those muscle groups that represent the infrastructure of stability for the body—abdominals, obliques, lower back and hips. Consequently, it's vital that these muscles groups be conditioned together and in balance. Some back injuries can be attributed to a weak core generally but, more precisely, back injury results from core strength imbalances. Essentially, the core is only as strong as the weakest link in the kinetic chain of the muscles activated. The very nature of the stress of centrifugal resistance is to condition the core to perform the function it's designed for, stability, while also representing a significant metabolic stress on the body.

A user selects a ball weight (or weighted ball) appropriate to training status/level, and grips the unit from the cross-bridge, then manipulates the continued spinning of the ball with the arms extended away from the body.

To compound exercise stress, this exercise can be combined:

perform revolutions in tandem with other exercises, particularly those that rely on the use of dumbbells to increase the intensity of effort (split squats, lunges, walking lunges, and their variations)

The degree to which the user extends the arms away from the body will affect the balance and contribution of the muscle groups engaged. For example, performing overhead revolutions with the arms perfectly straight will emphasize the core infrastructure of the abdominals, obliques, hips and lower back. Generally, the straighter the arms are, while using the unit, the more the core muscles are disproportionately recruited. However, using the device held closer to the body solicits greater help from the arms shoulders and upper back to execute the exercise.

BRIEF DESCRIPTION OF THE DRAWINGS

In order that the invention may be readily understood, specific embodiments thereof will now be described With reference to the accompanying drawings in which.

PARTICULAR DESCRIPTION

Figure 1:
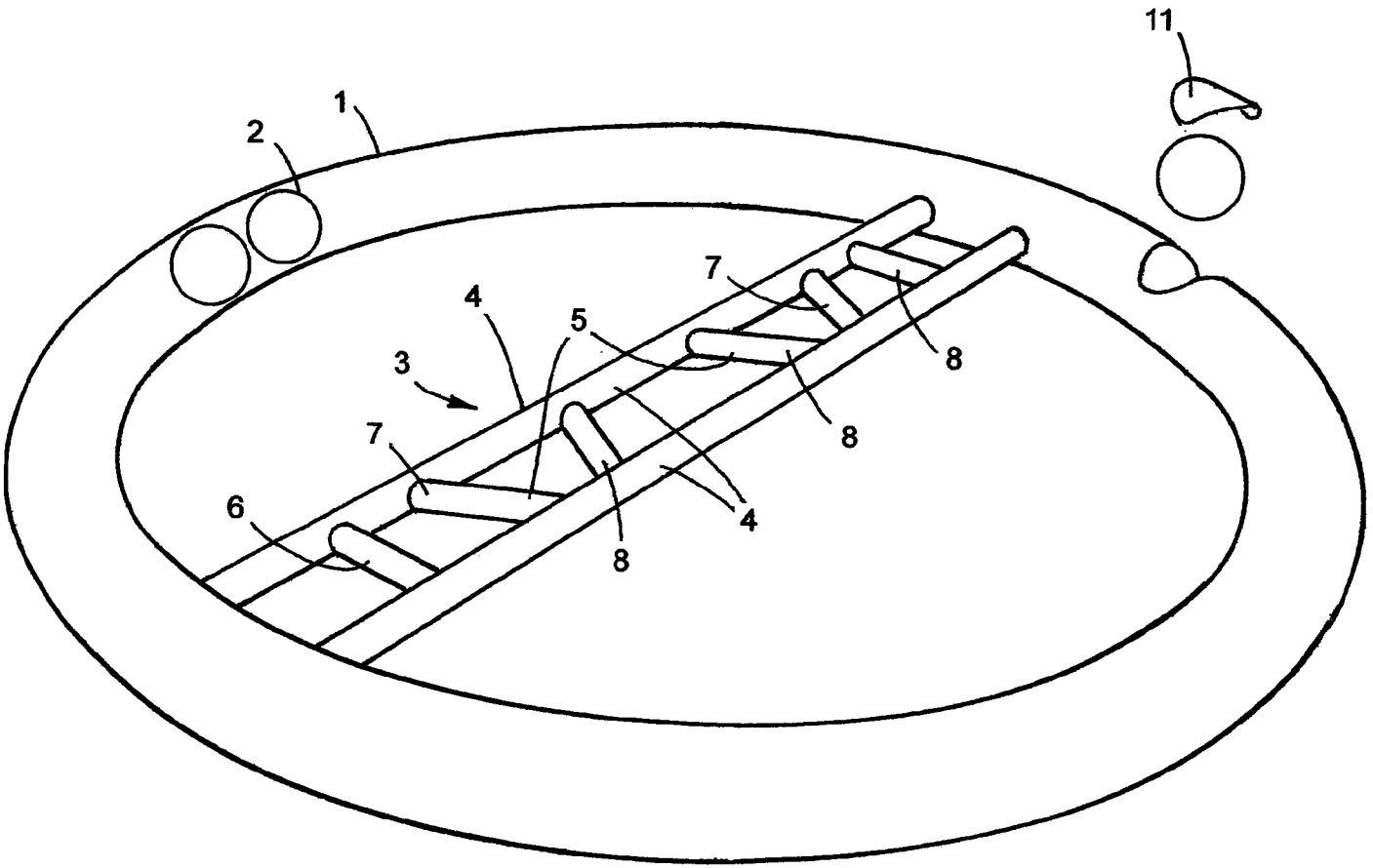
FIG. 1 is a perspective view of a first embodiment.

As shown particularly in FIG. 1, the exercise device comprises a circular, hoop-form tube 1 containing a plurality of ball weights 2 and a handle-forming cross-bridge 3 diametrically spanning the hoop. The handle-forming cross-bridge comprises a pair of straight bar members 4 connected at respective opposite ends to the inner circumference of the hoop to extend thereacross in parallel, spaced apart, side-by side relation and a series of (six) cylindrical hand-grips 5, connected in spaced apart relation at respective opposite ends to respective bar members to extend in spanning relation transversely thereof. The outermost pair of hand-grips 6 extend in parallel relation to each other, the adjacent, middle pair 7 are divergent, providing a semi-supinated grip and, the innermost pair 8 are convergent, providing a semi-pronated grip. A ball insert hatch 10 is provided in the tube and a cover 11, for closure thereof.

Figure 2:
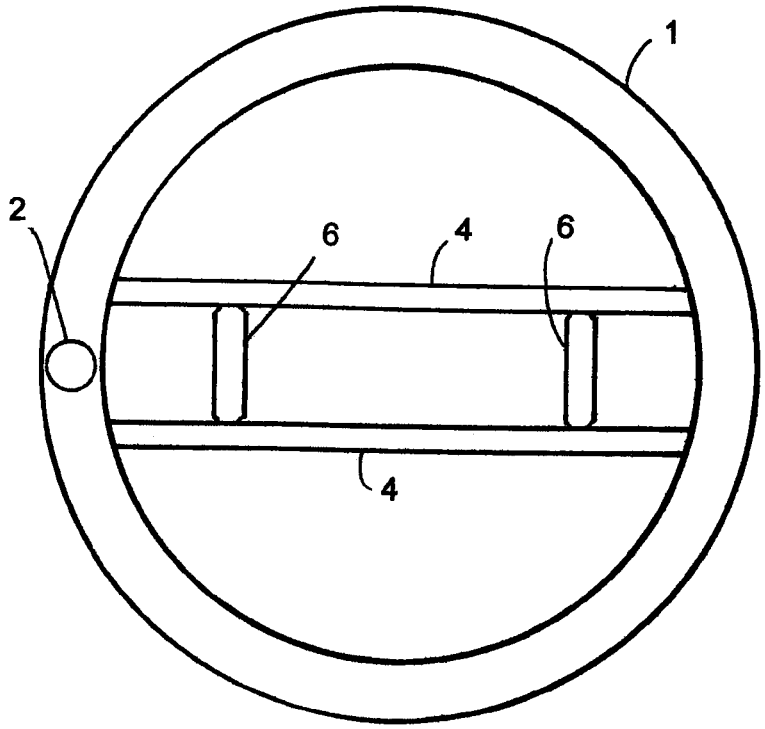
FIG. 2 is a plan view of a second embodiment.

The second embodiment shown in FIG. 2 is similar to the first, but comprises only a single pair of hand grips, which are parallel. Typical dimensions are shown.

Figure 3:
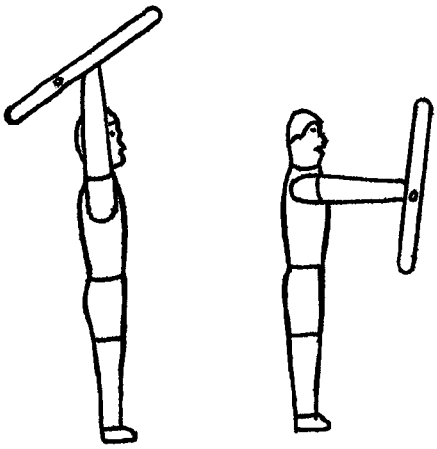
FIG. 3 is a schematic view showing the user standing while operating either embodiment in an overhead or frontal orbit.
Figure 4:
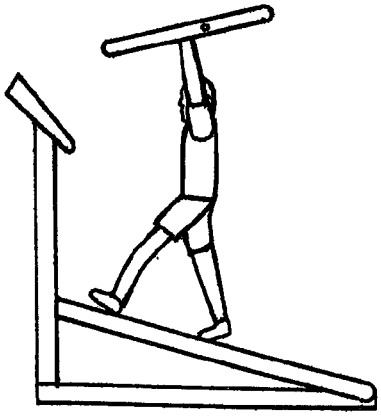
FIG. 4 is a schematic view of the user walking on a treadmill while orbiting the hoop overhead.
Figure 5:
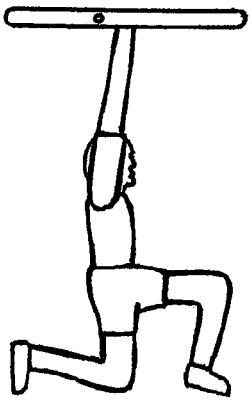
FIG. 5 is a schematic view of the user orbiting the hoop while lunging.
Figure 6:
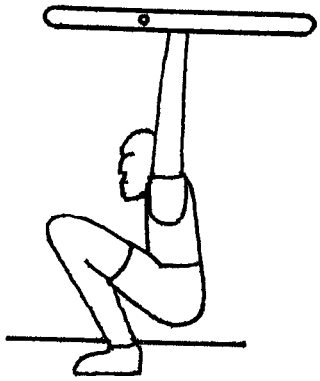
FIG. 6 is a schematic view of the user orbiting the hoop at the completion of a squat.
Figure 7:
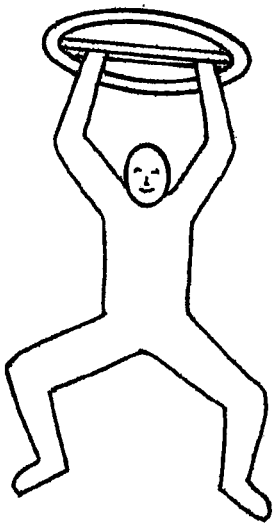
FIG. 7 is a schematic view of the user orbiting the hoop during an intermediate stage of a squat.
Figure 8:
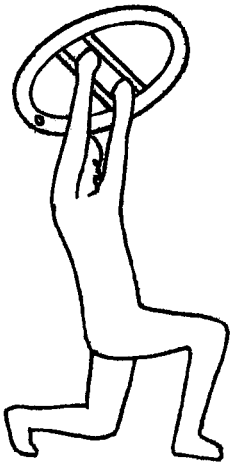
FIG. 8 is a schematic view of the user orbiting the hoop while performing a split squat.
Figure 9:
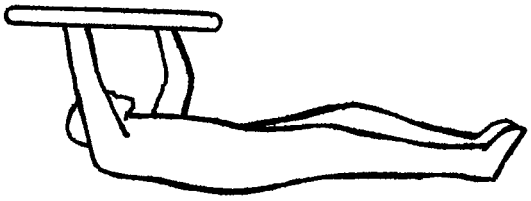
FIG. 9 is a schematic view of the user orbiting the hoop while supine on his back.

As shown in FIG. 3, the hoop can be orbited overhead or in front of the body by a standing user; in FIG. 4, overhead, while exercising on a treadmill; FIG. 5, overhead when performing a lunge; at the completion of a squat (FIG. 6); at an intermediate stage of a squat (FIG. 7); at the completion of a split squat (FIG. 8); and, when supine, lying on a back (FIG. 9)

Figure 10:
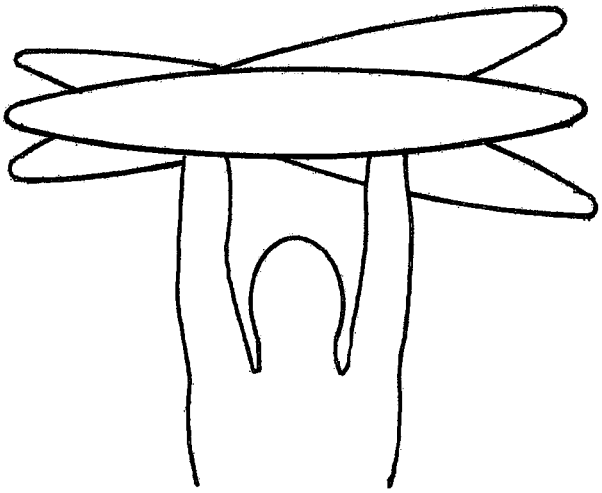
FIG. 10 is a schematic view of various substantially horizontal planes of an overhead orbiting operation by a user.

As shown in FIG. 10, although remaining substantially horizontal during orbit, there is a tendency for the front and rear of the hoop to tilt slightly, out from the precise horizontal plane during orbit in response to the change in position of the weight(s) during circulation.

Figure 11:
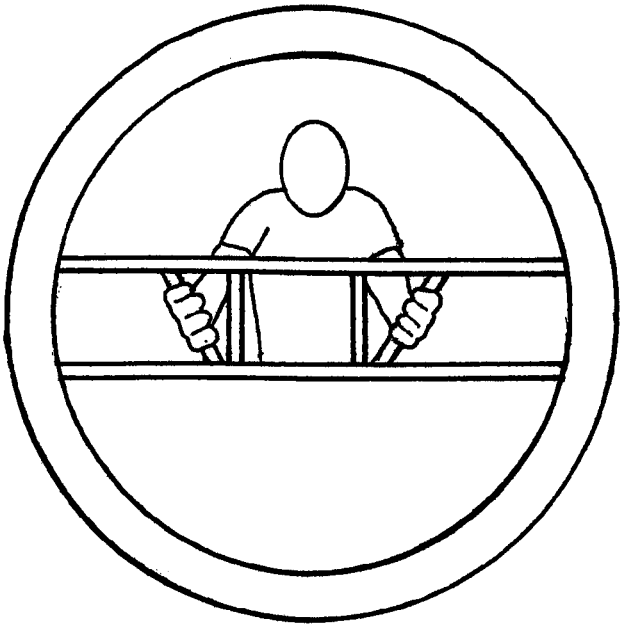
FIG. 11 is a schematic view of another embodiment with an pair of side-by-side, parallel hand grips spanning parallel, spaced apart bars of a handle bridging a hoop and an outer pair of side-by-side, oblique, semi-supinated, hand grips held by a user.
Figure 12:
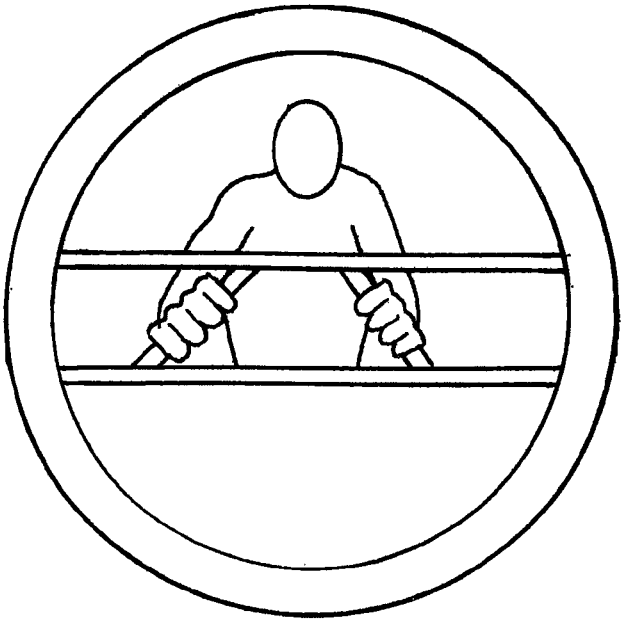
FIG. 12 is a schematic view of another embodiment with only a pair of side-by-side, semi-pronated grips spanning parallel, spaced apart bars of a handle bridging a hoop.
Figure 13:
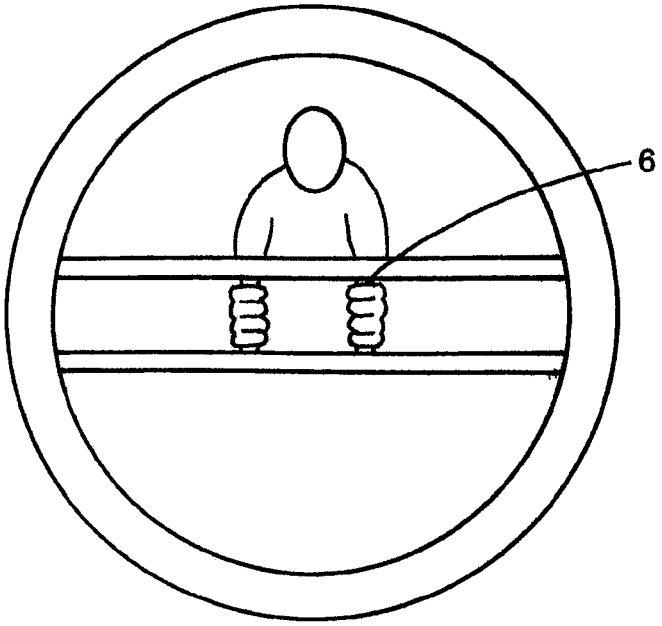
FIG. 13 is a schematic view of another embodiment with only a pair of side-by-side, parallel hand grips spanning parallel, spaced apart bars of a handle bridging a hoop.

FIGS. 11, 12 and 13, respectively, show the user positioned to orbit the hoop in front of the body by grasping a divergent pair of hand-grips 7 in a semi-supinated grip; grasping a convergent pair of hand-grips 8 in a semi-pronated grip; and, grasping a pair of hand-grips 6 extending parallel in side-by-side relation, each different grip exercising exercising particular sets of muscles to different degrees as discussed above.

Figure 14:
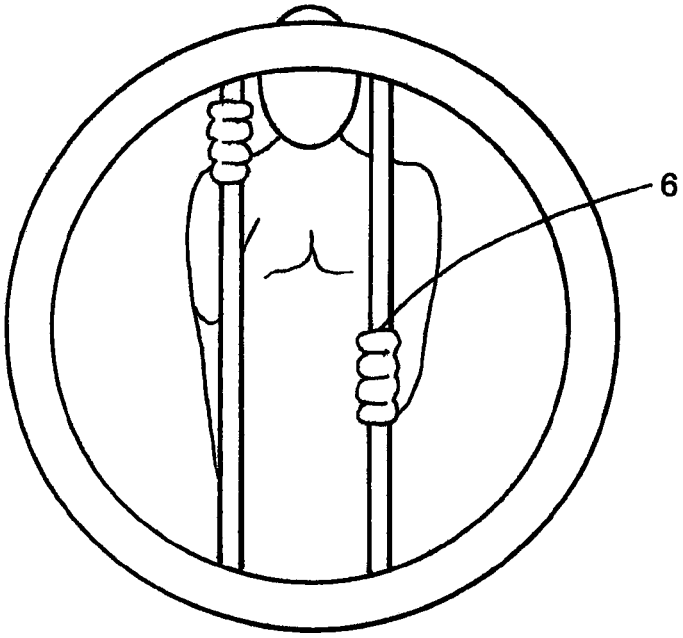
FIG. 14 is a schematic view of another embodiment with an pair of longitudinally offset (contra-lateral), parallel hand grips respective mounted in line on respective parallel, spaced apart bars of a handle, bridging a hoop.

As shown in FIG. 14, respective parallel hand grips 6 of a pair are located remotely at respective opposite ends of, and extending axially with, respective parallel cross bars, for employing a contra-lateral grip exercising different muscle sets to different extent.

Figure 15:
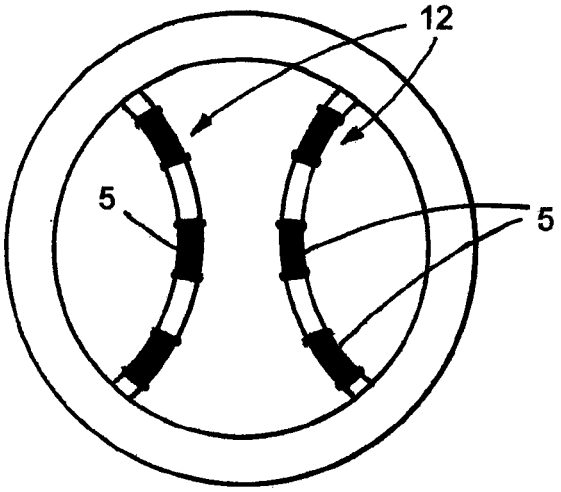
FIG. 15 is a schematic view of another embodiment with hand grips mounted at intervals on a pair of respective oppositely curved, convexly facing, handle bars bridging a hoop in side-by-side relation.
Figure 16:
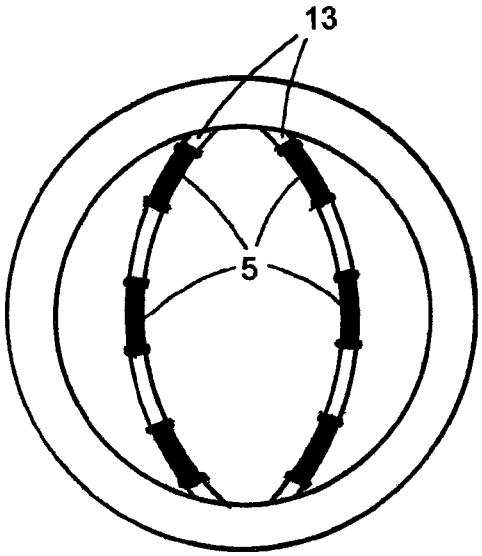
FIG. 16 is a schematic view of a further embodiment with hand grips mounted at intervals on concavely facing handle bars bridging a hoop in side-by-side relation.

In FIGS. 15 and 16, respectively, individual hand grips 5 are mounted at intervals on a pair of respective oppositely curved, convexly facing, handlebars 12 bridging a hoop in side-by-side relation and, (FIG. 16), on concavely facing handle bars 13 bridging a hoop in side-by-side relation. These enable the user to adopt a variety of diverse grips by varying their chosen hand grips from the most adjacent to the most remote pairs of semi supinated to semi-pronated for exercising particular selected sets of muscles with precision.

Figure 17:
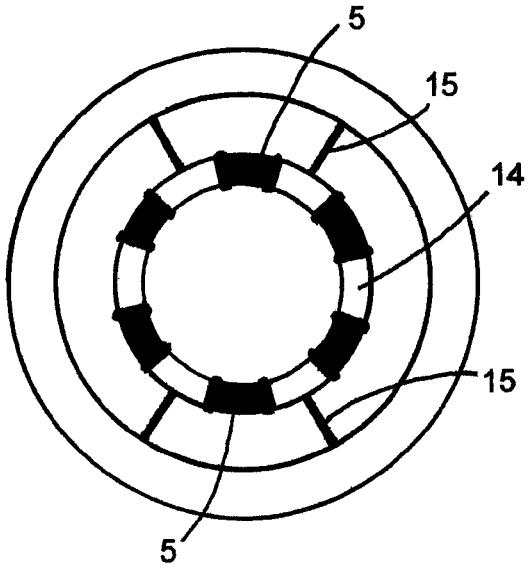
FIG. 17 is a schematic plan view of another embodiment in which a circular handlebar with hand grips distributed at equal intervals therearound is concentrically mounted within a hoop by four rubber shocks.
Figure 18:
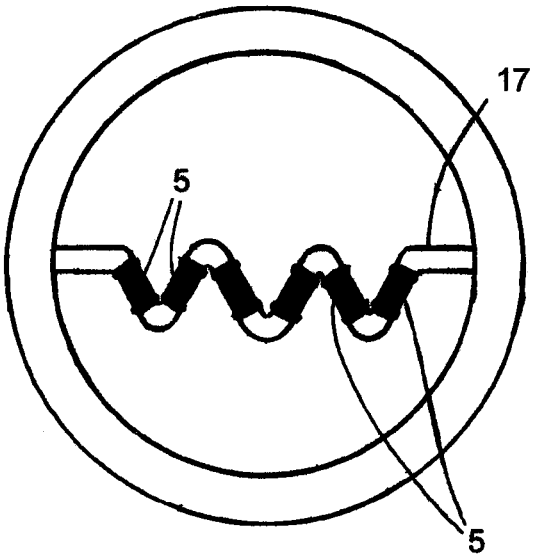
FIG. 18 is a schematic plan view of another embodiment in which a single handlebar cross-bridge spanning a hoop diametrically is formed zig-zag fashion with straight portions having hand grips mounted thereon such that successive hand-grips extend transversely, permitting multiple grip variations.

The suspension arrangement shown in FIG. 17 in which a circular handlebar 14 with hand-grips 5 distributed there-around is mounted concentrically within the hoop by radially extending spring members 15 (metal or elastomeric) provides both a well cushioned exercise action with less strain of the wrists and a choice of gripping positions. Locating hand-grips 5 on successive straight portions of a zig-zag single handlebar cross bridge 14, as shown in FIG. 18, enables a variety of hand grip positions to be accommodated to increase the variety of muscles to be exercised/trained using only a single device.

Figure 19:
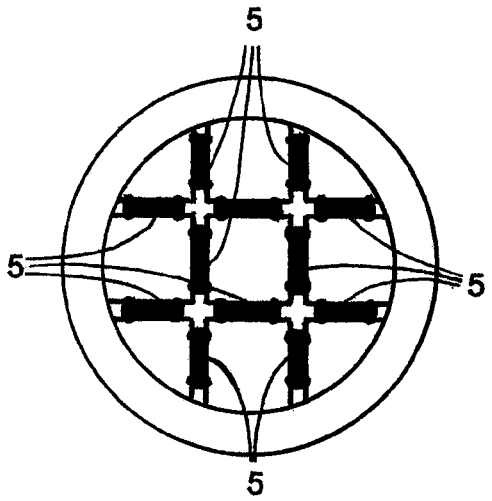
FIG. 19 is a schematic plan view of another embodiment in which two pairs of cross-bridge handles overlap/intersect orthogonally, each cross bridge having three, hand grips, equally spaced apart in line permitting multiple grip variations for contra-lateral gripping.

The matrix arrangement of hand-grips 5, on orthogonally extending handlebar pairs shown in FIG. 19, also increases the choice of hand positions with a commensurate increase in the variety of muscles trained with only a single device.

Figure 20:
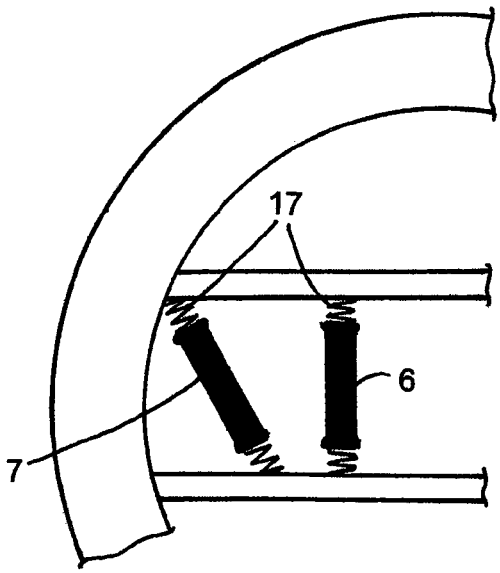
FIG. 20 is a schematic, fragmentary, plan view of another embodiment in which perpendicular and oblique hand grips are mounted at respective ends on respective cross bars by springs for a cushioning effect.
Figure 21:
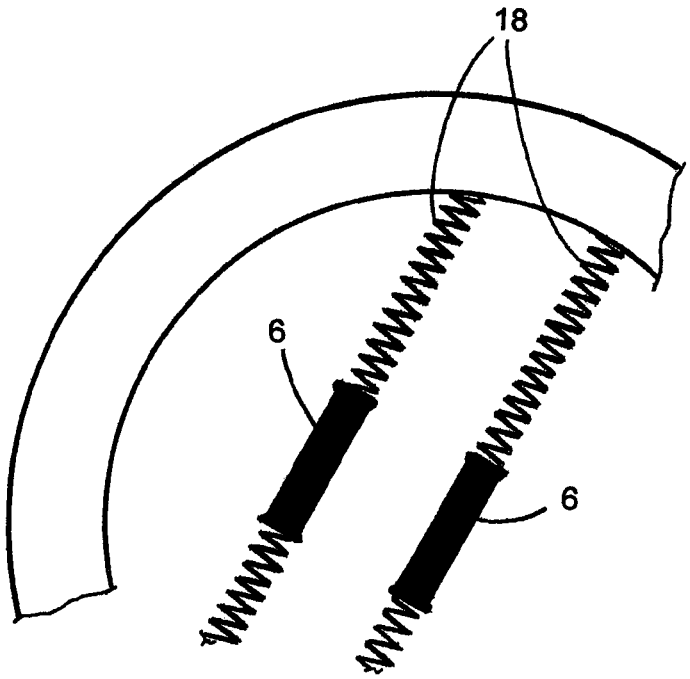
FIG. 21 is a schematic fragmentary plan view of another embodiment in which in an otherwise bridgeless structure, two hand grips are mounted at their respective ends to a hoop to extend spaced apart in parallel side-by-side, by relatively stiff springs.

Additional versions of cushioned hand-grips are shown in FIGS. 20 and 21. In the former, the hand grips 6 and 7 are suspended transversely on the parallel cross-bars entirely by metal coil springs 17 on respective ends while in FIG. 21, in-line springs 18 mount respective ends of parallel hand-grips 6 directly to the hoop.

The hoop is made of K resin so th at it is both lightweight and extremely strong. The cross-bar and hand grips are of polyamide nylon and the grips comprise sleeves of TPE. The ball weights should be stainless steel.

The invention claimed is:

1. A personal exercise device comprising:

a hoop-form tube of diameter configured to be sufficient to encircle a users body;

at least one weight contained for circulation in the tube;

a cross-bridge handle spanning the hoop-form tube; and, a pair of elongate hand grips located in spaced apart relation on the cross-bridge handle at locations spaced apart inwardly of the hoop-form tube and extending transversely of the cross-bridge handle, so that a standing user swinging the hoop-form tube in a generally horizontal orbit overhead by grasping respective hand grips with respective hands can develop sufficient centrifugal force in the circulating weight to impose alternate push-pull exercising stresses on respective muscles of the users arms, shoulders and upper back, to exercise the component agonist and antagonist muscles while relaying/radiating sufficient exercise stresses to train the core muscles of the trunk/torso including the abdominal and lower back muscles, wherein:

the cross-bridge handle comprises a pair of parallel, cross-bar members extending in spaced-apart relation in a plane of the hoop and the hand grips span respective cross-bar members;

the hand grips extend in parallel relation whereby core muscles on opposite sides of the body are stressed equally;

a further pair of elongate hand grips are mounted on the cross-bridge handle to extend transversely thereof at respective locations spaced inwardly of respective hand grips of the pair oft hand grips which extend in parallel relation, the hand grips of the further pair being divergent to produce a semi-supinated grip; and an additional pair of elongate, hand grips are mounted on the cross-bridge handle to extend transversely thereof in spaced-apart relation, at locations spaced inwardly of respective hand grips of the pair of hand grips which extend in parallel relation, the hand grips of the additional pair being convergent to produce a semi-pronated grip.

2. The personal exercise device according to claim 1 wherein respective hand grips of the pair of divergent hand-grips alternate on the cross-bridge handle with respective hand grips of the additional pair of hand-grips which are convergent.

* * * * *